United States Patent [19]

Geyer et al.

[11] Patent Number: 5,016,310

[45] Date of Patent: May 21, 1991

[54] FLOOR SCRUBBER HAVING LATERALLY VARIABLE SCRUB BRUSH POSITION

[75] Inventors: Robert A. Geyer, Champlin; Terence A. Peterson, Plymouth, both of Minn.

[73] Assignee: Tennant Company, Minneapolis, Minn.

[21] Appl. No.: 396,132

[22] Filed: Aug. 21, 1989

[51] Int. Cl.[5] ..... A47L 11/16

[52] U.S. Cl. ..... 15/49.1; 15/87; 51/177

[58] Field of Search ..... 15/49 R, 50 R, 79.1, 15/87, 340.3, 340.4; 51/177; 56/15.5

[56] References Cited

U.S. PATENT DOCUMENTS

| | | | |
|---|---|---|---|
| 3,436,788 | 4/1969 | Tamny | 15/340.3 |
| 4,160,302 | 7/1979 | Hirst et al. | 15/87 |
| 4,368,554 | 1/1983 | Mealing et al. | 15/87 |
| 4,490,874 | 1/1985 | Duncan | 15/87 |
| 4,691,402 | 9/1987 | Veselka | 15/87 |

FOREIGN PATENT DOCUMENTS

| | | | |
|---|---|---|---|
| 2241901 | 3/1974 | Fed. Rep. of Germany | 15/340.3 |

*Primary Examiner*—Edward L. Roberts

*Attorney, Agent, or Firm*—Kinzer, Plyer, Dorn, McEachran & Jambor

[57] ABSTRACT

A floor scrubbing machine has scrub brushes and their drive motors mounted in a scrub head located amidships under the machine frame. Provision is made to move the scrub head laterally on occasion to a position where it extends beyond one side of the machine frame to facilitate scrubbing along walls, thereby eliminating the need for a scrubbing side brush. The scrub brushes bear evenly against the floor regardless of the lateral position of the scrub head even though a variable down force may be applied to the scrub head. The scrub head is resiliently attached to the means for moving it laterally so that if it encounters a solid obstacle while it is extended it will be yieldably pushed back under the machine frame with a minimum likelihood of damage, and then will automatically extend out again after the obstacle is past.

14 Claims, 3 Drawing Sheets

FLOOR SCRUBBER HAVING LATERALLY VARIABLE SCRUB BRUSH POSITION

BACKGROUND

In the design of industrial floor scrubbing machines it is common to mount the scrub brushes and their drive motors in a housing called a scrub head. This scrub head is commonly attached in some articulated manner to the frame of the machine so that the brushes can be raised for transport and lowered to the floor for working, and when working will bear against the floor even though it may undulate somewhat. The scrub head is variously mounted in front of, underneath amidships, or behind the machine frame, and a suction pickup squeegee is universally used to pick up the soiled scrub water. The scrub head and the squeegee are commonly within the width of the machine frame, for they are vulnerable to being damaged by collision with fixed objects if they extend much wider than the frame. A scrub brush within a machine frame width cannot scrub closely along a wall, however, because of the surrounding machine structure. So a scrubbing side brush is often provided at a front corner of the machine, extending out forwardly and laterally beyond the machine frame, to scrub along walls. Side brushes, however, are quite vulnerable to being damaged by collisions with fixed objects, and their scrubbing pattern on the floor often does not match the pattern of the main brushes. In sharp turns a side brush, because of its forward location, may track outside of the pickup squeegee and consequently leave a trail of water on the floor which has otherwise been damp dried by the squeegee.

SUMMARY OF THE INVENTION

A primary object of this invention is an industrial floor scrubber without a scrubbing side brush and with a vertical force other than gravity applied to its main scrubbing brushes, which can scrub closely along a wall like a scrubber equipped with a scrubbing side brush, thereby eliminating the shortcomings of a side brush while retaining its useful function.

Another object is a scrubber having a scrub head containing scrub brushes which on occasion can be extended laterally outside the frame of the scrubber to scrub closely along a wall or can be operated in a normal position under the scrubber for minimum machine width.

Another object is a resilient coupling between the scrub head and the means for extending it laterally so that it can automatically retract in event of striking a solid obstacle and automatically extend again after passing the obstacle.

Another object is means for applying a vertical force other than gravity to the scrub head which will be unchanged in direction or magnitude by moving the scrub head from a normal position under the scrubber to a laterally extended position or vice versa.

Another object is to assure uniform contact pressure of the scrub brushes against the floor in both normal and extended positions of the scrub head by locating the vertical force on the scrub head, the center of gravity of the scrub head, and the center of the contact area of the scrub brushes with the floor in one vertical line.

A preferred embodiment of the invention is a battery powered industrial scrubber on which the operator rides. It is a tricycle vehicle, with a single steerable, powered wheel in front and two free rolling wheels in the rear. With a scrub head mounted amidships such a vehicle can readily be steered close to a wall, scrub along it, and be steered away from it at will. As described herein, the scrubber has a scrub head assembly which carries two disc type scrub brushes and their two electric drive motors with reduction gear boxes, but there is nothing in the invention which limits the number or type of brushes, or the type of drives used. The scrub head is also provided with means for dispensing scrub water, and suitable skirting for water control. Its location amidships under the machine frame places it closer to the pick up squeegee at the rear of the machine than a front mounted scrubbing side brush would be, which improves water control during turns. The scrub head assembly is attached to the scrubber frame with two parallel ball jointed links on each side, which pull it along. These links allow it to be lifted for transport or lowered to the floor for working, and to follow an uneven floor. They also allow it to move from side to side. This latter capability is utilized by mounting a linear electric actuator or the like crosswise under the machine frame and connecting it to the scrub head. The actuator may be retracted or extended. When in retracted position it locates the scrub head under the machine frame, which is its normal position, for best protection against damage and best relationship to the squeegee. However, by extending the actuator the scrub head may be moved laterally, extending it, say, about five inches beyond the side of the machine frame. When thus extended, the main scrub brush on the extended side can scrub as close to a wall as a side brush could, so no scrubbing side brush is needed. The actuator is resiliently coupled to the scrub head through a gas spring which is normally extended. The outer end of the scrub head has an angled bumper plate on it, so that if the protruding scrub head strikes an obstacle it will be deflected off and pushed back under the machine, compressing the gas spring, and thus will generally avoid being damaged. It swings in or out easily because, as mentioned before, it is attached to the frame with ball jointed links. After passing the obstacle the gas spring will automatically extend and push the scrub head out again.

There is a second electric actuator or the like mounted longitudinally on the underside of the scrubber frame and connected through a spring loaded bell crank and a linkage to the scrub head to raise it for transport and lower it to the floor for work. This system can be and preferably is made capable of exerting a variable vertical force on the scrub head which will increase or decrease the pressure of the brushes against the floor. This pressure may be and preferably is automatically controlled in accordance with U.S. Pat. No. 4,757,566, which varies the vertical force on a scrub head to control the torque developed in the brushes of a scrubber. The load current in one or both of the brush motors, which will vary as the brush torque, is sensed to provide the necessary control feedback. Some other mode of control may be used if preferred; the invention does not limit this. In any case the actuator will extend or retract and thus apply more or less vertical force on the scrub head.

The actuator is connected through its bell crank to the scrub head in such a way that the upward or downward force on the scrub head will be vertical whether the scrub head is in its normal position under the frame or extended out. This is accomplished by connecting the actuator bell crank to the scrub head with a four bar linkage that gives a straight line lateral motion of a movable member. One that was found to be suitable is known as Tchebicheff's linkage. By its use the actuator is made to apply a vertical force to the point where the linkage attaches to the scrub head regardless of the scrub head's lateral position.

One of the most important specifications of scrubber design is that the scrub brushes exert a uniform pressure on the floor over the entire area in which they contact it. The center of contact area of the brushes with the floor and the center of gravity of the scrub head assembly both coincide with the vertical line of force exerted on the scrub head by the actuator, bell crank and linkage as described above.

In summary, the invention is directed at the problem of building an improved industrial floor scrubber with the capability of scrubbing closely along a wall without a scrubbing side brush to avoid the problems inherent with side brushes, and having vertical force in addition to gravity applied to its scrub head, for example as taught by U.S. Pat. No. 4,757,566.

The main brushes are built into a scrub head which can have a vertical force applied to it and which can be operated on occasion in a position where the brushes are extended laterally beyond the side of the frame and thus can scrub along a wall in the same manner as a side brush.

The mechanism which provides vertical force on the scrub head is connected to the scrub head in such a way that it will apply vertical force whether the brush head is in normal position or extended. A four bar linkage attributed to Tchebicheff meets this requirement. Other linkages or mechanisms will perform this function also.

The elements of the scrub head assembly which contribute to its weight ar disposed in such a way that the center of gravity of the scrub head is in a vertical line with the center of the contact area of the scrub brushes with the floor. The linkage which applies vertical force is attached to the scrub head where its force is applied in this same vertical line.

The scrub head needs lateral and vertical movement, which is achieved in a preferred way by attaching it to the scrubber frame with ball jointed parallel links.

A resilient connection is applied between the scrub head and the actuator that moves it laterally to allow the extended scrub head to automatically retract upon contact with a fixed object, thereby avoiding damage, and then to automatically extend again after passing the obstacle.

All figures are schematic, showing only those parts related to the invention, and with many conventional parts omitted.

DETAILED DESCRIPTION OF THE ILLUSTRATED EMBODIMENT

Figure 1:
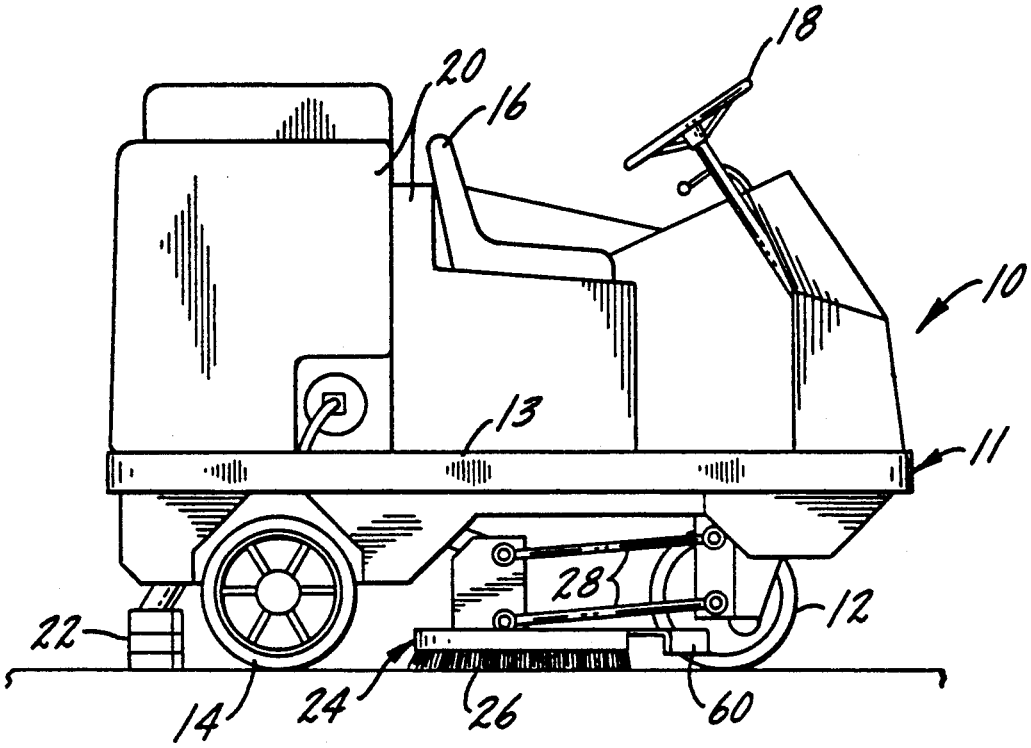
FIG. 1 is a side view of a floor scrubbing machine which uses the present invention.

FIG. 1 shows an industrial floor scrubbing machine, commonly referred to as a scrubber, and generally designated by the number 10. It utilizes the present invention, which will be described in detail. In all other respects, however, it is a conventional scrubber. The scrubber has a frame 11 which supports the various machine components and includes two longitudinal members 13 along the sides of the machine. Only one of these is shown in FIG. 1; the other may be assumed to be similar and on the far side of the machine. It may be battery powered, with a single front wheel 12 which is motor driven and is also steerable. Two rear wheels 14 support the rest of the weight. There is a seat 16 for an operator, a steering wheel 18 and suitable controls. There are tanks 20 for storage of clean and dirty scrubbing solution and a vacuum pickup squeegee 22 for removing dirty water from the floor and putting it in a storage tank. All of these elements and their arrangement are conventional, and will be familiar to a person knowledgeable in the art.

The brushes, motors and related parts are assembled in a scrub head which is generally designated by the number 24 in the drawings. The working tools of this scrubber are two disc type scrub brushes 26 rotating about vertical axes and driven by electric motors through reduction gears. This is a conventional arrangement, and so is only shown schematically in the drawings. The scrub head also includes means for applying scrubbing solution to the floor and suitable skirts for water control. These elements are conventional and so may be omitted in the drawings. The scrub head is mounted in a midship location under the frame of the scrubber between the front wheel and the rear wheels. It is attached to the scrubber primarily by two parallel ball jointed links 28 on each side. These are of the type commonly used in automotive tie rods. They keep the scrub head level fore and aft, but allow it to move up and down so it can be raised for transport and lowered for working. When in the working position it can rise or fall to follow the undulations of an uneven floor surface. They will also allow it to be moved laterally, which will be discussed later.

Figure 2:
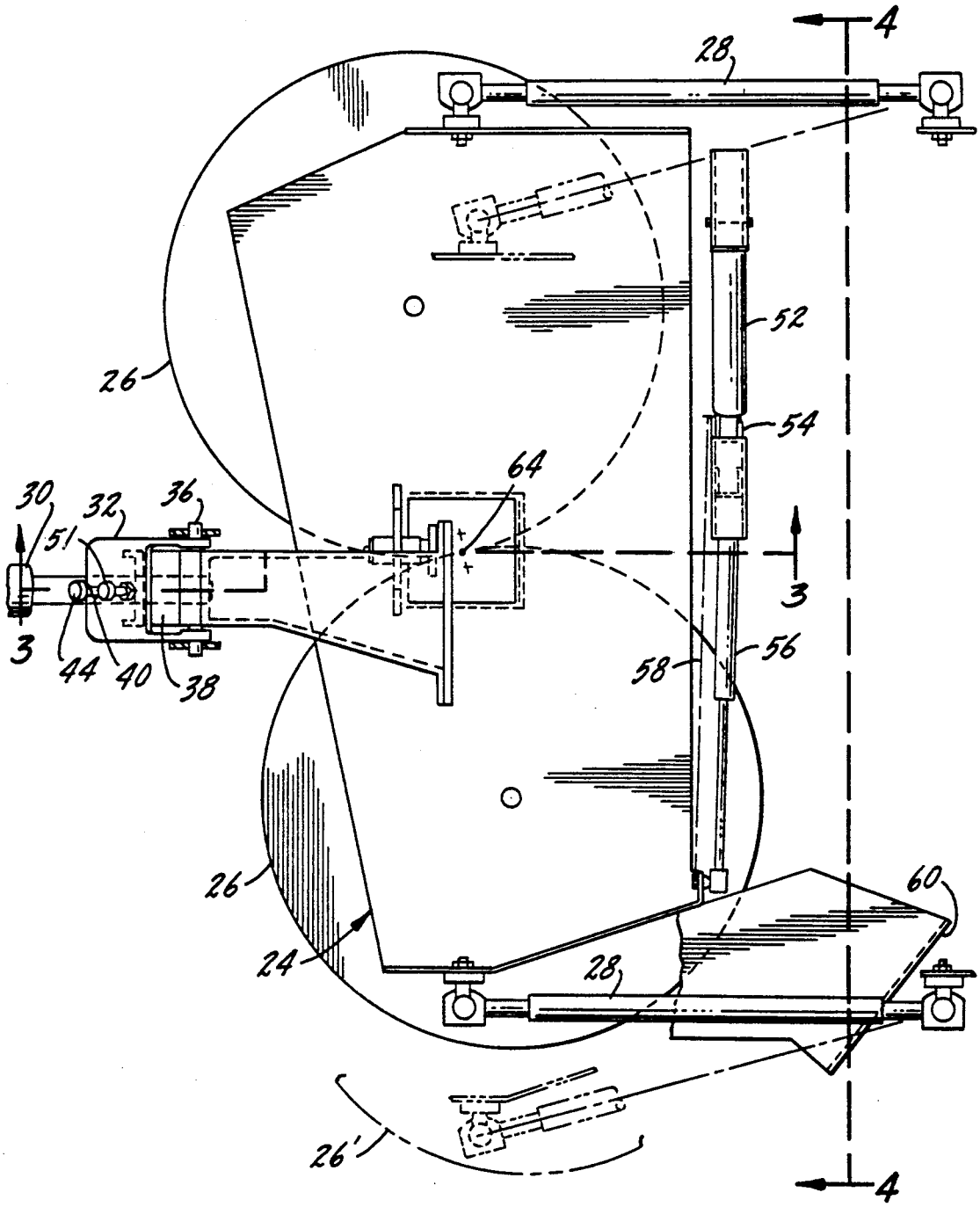
FIG. 2 is a plan view of the scrub head of the machine of FIG. 1, showing its suspension in the scrubber.
Figure 3:
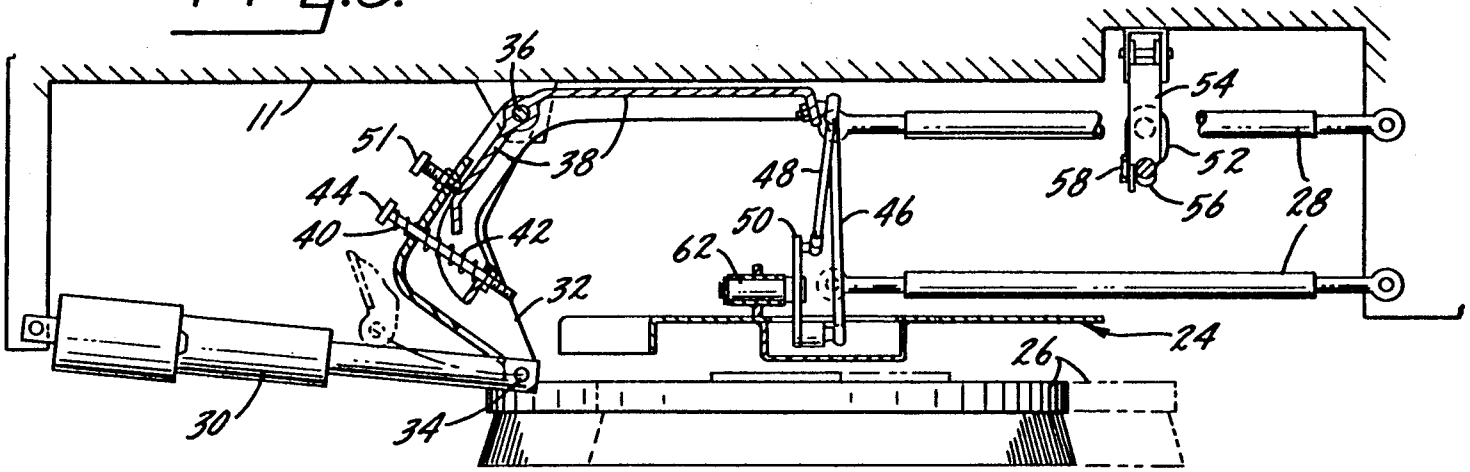
FIG. 3 is a longitudinal section view of the scrub head on line 3—3 of FIG. 2 with some parts in full and others broken away for clarity.

Vertical force is applied to the scrub head by an electric linear actuator 30 or the like in FIG. 2 mounted longitudinally to the frame 11 generally under the center of the machine and acting through a spring loaded bell crank and linkage system. As best shown in FIG. 3, actuator 30 is connected to bell crank 32 by pivot pin 34. Bell crank 32 is pivotally attached to the frame 11 of the machine by pivot pin 36. Another bell crank 38 is also pivotally attached to the frame by this same pivot pin 36. Bell crank 32 is moved by actuator 30, and this movement is transmitted to bell crank 38, but is cushioned by springs 40 and 42, which are retained in place by guide bolt 44. The movement of bell crank 38 is transmitted to the scrub head by two identical ball jointed links 46, 48, and pivoted link 50. The action of these links will be described later.

As seen in FIG. 3, when actuator 30 is extended it will cause bell crank 32 to move in a counterclockwise direction around pivot pin 36. Spring 42 will be compressed and will exert an increasing force on bell crank 38 that will tend to rotate it counterclockwise around pivot pin 36. This will tend to lift up links 46, 48 and 50, which will tend to lift up the scrub head 24. If the actuator 30 continues to extend, bell crank 32 will continue to compress spring 42 until stop bolt 51 contacts a surface of bell crank 38. After that, further extension of actuator 30 will cause bell cranks 32 and 38 to move counterclockwise as one, positively lifting the scrub head 24 and its attached scrub brushes 26 to a raised position for transport.

Still referring to FIG. 3 when actuator 30 retracts it will move bell crank 32 in a clockwise direction. If the weight of the scrub head is being supported by bell crank 38, as during transport, then bell crank 38 will move clockwise with bell crank 32 until the brushes 26 contact the floor and support the weight of the scrub head. Further retraction of actuator 30 will compress spring 40 and through guide bolt 44 will exert a further clockwise force on bell crank 38, which through links 46, 48 and 50 will exert a further downward force on the scrub head and brushes. It can be seen that when the brushes are in working position small extensions and retractions of actuator 30 will compress either spring 42 or spring 40 to exert a variable upward or downward force on the brushes.

U.S. Pat. No. 4,757,566 teaches that a desired torque load in such brushes working against a floor can be maintained essentially constant by suitable electronic controls. The load current in the brush drive motors will vary as the torque developed by the brushes, and a device which senses this motor load current can be used to cause an actuator such as 30 to extend when the load current increases or retract when the load current decreases. This will vary the pressure of the brushes against the floor, which will vary the torque that they will develop. Thus a feedback loop can be used which will hold the brush torque essentially constant at a desired value. The springs 40 and 42 cushion the action and give the brushes some resilient compliance with floor irregularities before the feedback loop has had time to extend or retract the actuator. This system for controlling brush force is applied in the scrubber of the present invention. It is desirable that there be some means of exerting vertical force on the scrub head through links 46, 48 and 50 when the brushes are working. The details of the control of that force is not part of this invention.

As mentioned earlier, the method used to permit scrubbing close to a wall without a scrubbing side brush is to laterally extend the scrub head 24 out beyond one side of the machine frame, for example, about five inches. This will extend one brush 26 to position 26' as shown in FIG. 2, which places it in position to scrub as close to a wall as a side brush could do. The lateral position of the scrub head is controlled by an actuator 52 which is mounted transversely under the scrubber frame 11, best shown in FIG. 4. It is connected to a swinging lever 54 which is pivotally anchored to the scrubber frame. A gas spring 56 is connected between swinging lever 54 and one of the upstanding brackets on the scrub head 24. The gas spring is normally extended, but a steel cable 58 is also connected parallel to it between lever 54 and the scrub head bracket to keep the gas spring from extending quite to its full length. The cable mainly protects the internal elements of the gas spring by taking the tensile forces developed during retraction of the scrub head to normal position. Electronic controls are provided so that the operator can extend actuator 52 when it is desired to scrub along a wall, and retract it to its normal position under the scrubber frame at other times. Extension or retraction of the actuator 52 will be transmitted through swinging lever 54 and gas spring 56 or cable 58 to the scrub head 24. The gas spring will push it out and the cable will pull it back. There is an angled deflector plate 60 which is an integral part of the scrub head. It extends out far enough to serve as a bumper. If the extended scrub head strikes a fixed object the plate 60 will slide along it and push the scrub head back under the machine frame, thus generally avoiding damage to it. The gas spring will compress and the cable will go slack to allow this. After the obstacle has been passed the gas spring will extend until the cable becomes taut, thus automatically moving the scrub head out again.

It is common in scrubber design to apply skirting which drags on the floor along the sides of the scrub head to keep scrub water on the floor from spreading out sidewise. Such side skirts commonly curve inward somewhat at their rear ends to direct the water back to the pickup squeegee. This practice is followed in the scrubber of this invention, the only departure from standard practice being that the rear ends are brought farther inward than usual so that water on the floor will be channeled within the width of the pickup squeegee when the scrub head is in its extended position.

Figure 5:
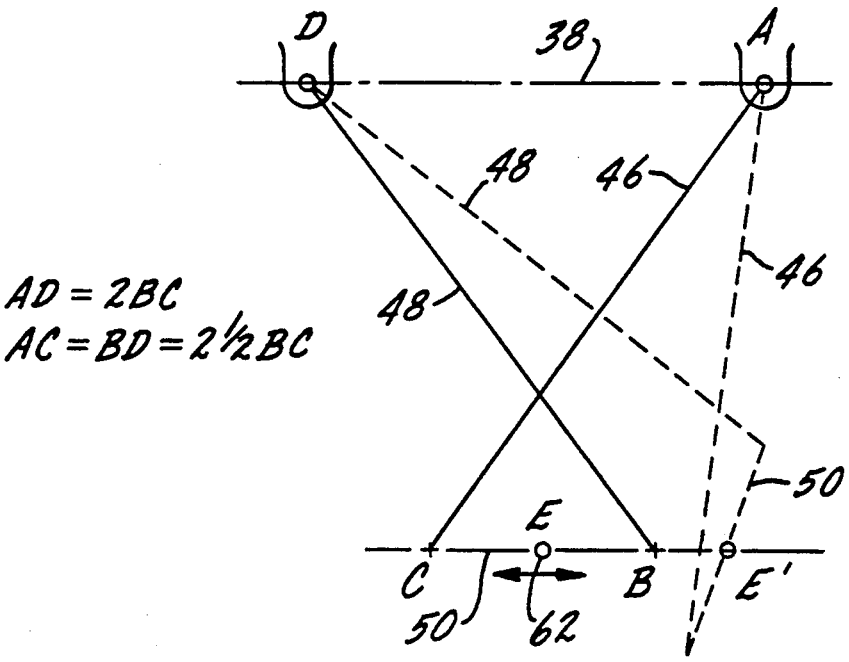
FIG. 5 is a diagram of the linkage used to transmit vertical force to the scrub head.
Figure 4:
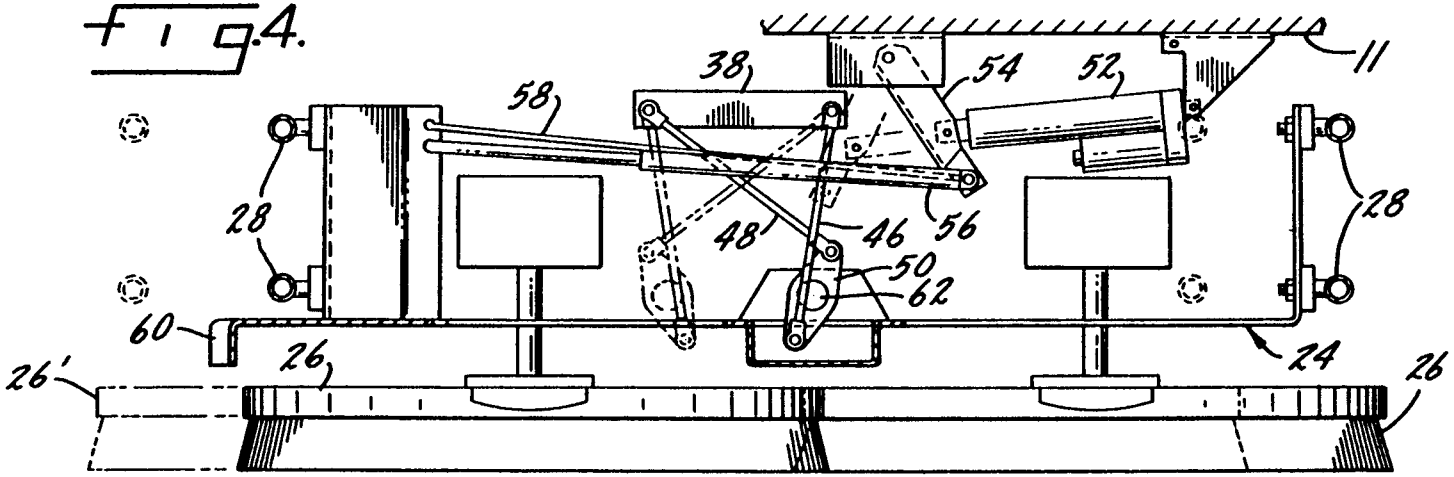
FIG. 4 is a front view of the scrub head on line 4—4 of FIG. 2.

As described earlier, there may be more or less vertical force applied to the scrub head in its working position by actuator 30, which is coupled to the scrub head through a bell crank and linkage system. It is desirable to keep this force vertical for both the retracted and extended positions of the scrub head. Bell crank 38 is coupled to the scrub head with a linkage that delivers straight line lateral motion. As shown in FIG. 4 and diagrammatically in FIG. 5, there is a pivoted link 50 rotatably mounted at its center 62 on the scrub head. There are two identical ball jointed links 46 and 48 connecting between pivoted link 50 and bell crank 38. Comparing these parts to the geometry shown in FIG. 5, pivoted link 50 compares to member BC, with the pivot center 62 of link 50 comparing to point E. Ball jointed link 46 compares to member AC, ball jointed link 48 compares to member BD, and bell crank 38 compares to member AD. The length relationships indicated under FIG. 5, AD=2BC, etc., are true of the particular linkage shown but do not necessarily apply to other mechanisms that will perform the same function. This particular linkage has the characteristic that although bell crank 38 does not move laterally, pivot center 62 can and does move straight laterally between point E to E' when the scrub head is moved in or out. FIG. 4 shows in solid lines the positions of the links when the scrub head is in normal position, and in phantom lines their positions when the scrub head is extended. A force analysis of this linkage system will show that a vertical force exerted by bell crank 38 will be transmitted by the linkage as a vertical force to pivot center 62 and thence to the scrub head without change, regardless of whether the scrub head is in normal position or extended position or in any intermediate position between normal and extended.

It is important in any scrubber that the brushes exert a uniform pressure on the floor over the entire area of contact between the brushes and the floor. This is done in the scrubber of the present invention by causing the center of the contact area of the brushes with the floor and the center of gravity of the scrub head assembly to both lie in one vertical line, and the vertical force applied by actuator 30 to be applied in that same vertical line. That vertical line is shown as point 64 in FIG. 2, which is a plan view, so a vertical line appears as a point. Point or line 64 intersects a line connecting the centers of brushes 26, 26, and is equidistant between those centers, so it is in the center of the brush contact area. The brush drive motors, reduction gear boxes, and other functional elements mounted on the scrub head which contribute to its weight are disposed in such a way that the center of gravity of the scrub head assembly also lies on line 64. The pivot centerline 62 of link 50 passes through line 64. The ball jointed links 46 and 48 exert vertical force on link 50, which transmits it to the scrub head at centerline 62, so the vertical force applied by actuator 30 is applied along line 64.

Whereas the preferred form of the invention has bee shown and described herein, it should be realized that there can be many modifications, substitutions and alterations thereto which would still fall within the scope of the invention.

We claim:

1. An improved machine for scrubbing a floor, comprising a plurality of wheels including one or more front wheels and one or more rear wheels supporting the machine for movement over the floor, a frame including two side members, one or more rotating floor engaging tools driven by one or more motors, the tools and motors being mounted in a scrub head, the scrub head being movably attached to the frame, means for raising the scrub head to a transport position where the tools do not contact the floor and lowering the scrub head to a working position where the tools do contact the floor, means for selectively positioning the scrub head in a normal position generally centered between the two side members and, at least in the working position, in an extended position where at least a portion of the scrub head extends laterally outside one of the side members, means for applying a generally vertical force other than gravity to the scrub head when it is in its working position, the improvement consisting of means to assure that the rotating tools engage a flat floor with an essentially uniform pressure over the entire floor area which they engage when the scrub head is in the working position and in the normal and the extended position.

2. The improved floor scrubbing machine of claim 1 in which the center of area of that portion of the tools in contact with the floor when in the working position and the center of weight of the scrub head including tools both coincide with the line of force where the generally vertical force other than gravity is applied to the scrub head, both in the normal position and in the extended position of the scrub head.

3. The improved floor scrubbing machine of claim 1 in which the generally vertical force other than gravity is applied by means mounted on the frame of the machine, and in which the said force applying means is connected to the scrub head by a linkage which transmits the force to the scrub head in a generally vertical direction regardless of whether the scrub head is in its normal position or its extended position or any intermediate position between normal and extended.

4. The force applying means of claim 3 in which the generally vertical force which it applies when the scrub head is in the working position and the tools are engaging the floor is automatically varied as the scrubber works so that the load in the tool drive motors remains essentially constant.

5. The improved floor scrubbing machine of claim 1 in which the means for selectively positioning the scrub head in a normal position or an extended position is mounted on the frame and is connected to the scrub head in a resilient manner.

6. The improved floor scrubbing machine of claim 5 in which the scrub head at its end which extends outside the machine frame in the extended position is equipped with a bumper such that if it collides with a solid object while the scrub head is in its extended position will deflect the scrub head toward its normal position.

7. The improved floor scrubbing machine of claim 1 in which the scrub head is mounted under the machine frame and amidships, being behind the front wheel or wheels and ahead of the rear wheel or wheels of the machine.

8. An improved machine for scrubbing a floor, comprising a plurality of wheels including one or more front wheels and one or more rear wheels supporting the machine for movement over the floor, a frame having two sides, one or more rotating floor engaging tools driven by one or more motors, the tools and motors being mounted in a scrub head, the scrub head being movably attached to the frame, means for raising the scrub head to a transport position where the tools do not contact the floor and lowering the scrub head to a working position where the tools contact the floor, means for selectively positioning the scrub head in various lateral positions on the frame, one applying a selectable down force generally on the cleaning head, and means for maintaining the selected down force constant in the various lateral positions of the cleaning head.

9. The structure of claim 8 further characterized in the yieldable means includes an air spring.

10. The structure of claim 8 further characterized by and including means for establishing a maximum laterally outward position of the scrub head relative to the frame.

11. The structure of claim 8 further characterized in that the scrub head is mounted generally amidships of the frame.

12. In a mobile cleaning machine for removing soilage from a surface to be cleaned, a mobile frame, a laterally movable tool containing a cleaning head on the frame and means for moving it constructed and arranged so that the cleaning head may be made to move to various lateral working positions and to project a desired amount beyond at least one side of the frame in an extreme lateral working position, power means on the frame for applying a selectable down force generally on the cleaning head, and means for maintaining the selected down force constant in the various lateral positions of the cleaning head.

13. The structure of claim 12 further characterized by and including yieldable means between the cleaning head and the power means for applying a selectable down force.

14. The structure of claim 12 further characterized by and including means for maintaining a constant torque on the tool.

* * * * *

UNITED STATES PATENT AND TRADEMARK OFFICE

CERTIFICATE OF CORRECTION

PATENT NO. : 5,016,310

DATED : May 21, 1991

INVENTOR(S) : Robert A. Geyer, et al.

It is certified that error appears in the above-indentified patent and that said Letters Patent is hereby corrected as shown below:

Column 8:

Claim 8, line 31, after "one" delete the remainder of the claim and replace with the following:

--position being generally centered between the two sides and another position being an extended working position where a portion of the scrub head extends laterally outside one of the sides of the frame, means for applying a generally vertical force between the frame and the scrub head resulting in a down force on the scrub head when it is in its working position, means for maintaining the down force generally constant in the various lateral positions of the scrub head, and yielding means between the frame and the scrub head that allows the scrub head to automatically retract when it is in its extended position to prevent damage when it strikes an object.--

Claim 9, line 36, at the end of the line, insert --that--

Signed and Sealed this

Seventh Day of September, 1993

Bruce Lehman

*Attest:*

BRUCE LEHMAN

*Attesting Officer*

*Commissioner of Patents and Trademarks*